US009416608B2

(12) United States Patent
Ruffo

(10) Patent No.: US 9,416,608 B2
(45) Date of Patent: Aug. 16, 2016

(54) SLIP, TANGENTIAL SLIP SYSTEM HAVING SLIP, AND METHOD THEREOF

(71) Applicant: Antonio C. Ruffo, Cypress, TX (US)

(72) Inventor: Antonio C. Ruffo, Cypress, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 569 days.

(21) Appl. No.: 13/944,017

(22) Filed: Jul. 17, 2013

(65) Prior Publication Data

US 2015/0021048 A1 Jan. 22, 2015

(51) Int. Cl.
*E21B 23/01* (2006.01)
*E21B 33/129* (2006.01)

(52) U.S. Cl.
CPC ..... *E21B 23/01* (2013.01); *E21B 33/129* (2013.01); *E21B 33/1291* (2013.01)

(58) Field of Classification Search
CPC .... E21B 23/01; E21B 33/129; E21B 33/1291
USPC ..... 166/382
See application file for complete search history.

(56) References Cited

U.S. PATENT DOCUMENTS 4,311,196 A 1/1982 Beall et al.
4,576,230 A 3/1986 Tapp et al.
4,762,177 A 8/1988 Smith, Jr.
4,830,103 A 5/1989 Blackwell et al.
5,487,427 A * 1/1996 Curington ..... E21B 23/01 166/217
6,119,774 A 9/2000 Doane et al.
6,213,204 B1 4/2001 Doane
7,604,061 B2 10/2009 Fay et al.
7,614,449 B2 11/2009 Anderson
2004/0216893 A1* 11/2004 Hirth ..... E21B 33/1291 166/382
2004/0244966 A1 12/2004 Zimmerman et al.
2009/0014173 A1 1/2009 MacLeod et al.
2009/0038808 A1* 2/2009 Anderson ..... E21B 33/129 166/382
2009/0056956 A1 3/2009 Ingram

FOREIGN PATENT DOCUMENTS

GB 2375560 A 11/2002
WO 0034621 A2 6/2000
WO 2006133425 A1 12/2006

OTHER PUBLICATIONS

International Search Report and Written Opinion Mailed Feb. 27, 2009, Written Opinion 7 pages, International Search Report 3 pages.

* cited by examiner

*Primary Examiner* — Jennifer H Gay
*Assistant Examiner* — George Gray
(74) *Attorney, Agent, or Firm* — Cantor Colburn LLP

(57) ABSTRACT

A slip for a tangentially loaded retrievable slip system includes a frame including an interior having first and second sides; and, a key having a first portion within the interior of the frame. The first portion of the key movable within the interior of the frame; wherein the key is movable from a set condition with at least a contact point of first and second sides of the first portion of the key pushing against at least a portion of the first and second sides of the interior of the frame in the set condition to an unset condition with the first and second sides of the first portion of the key releasing pressure from the first and second sides of the interior of the frame. Also included is a method of managing a tangential load imparted by a tangential slip system.

16 Claims, 6 Drawing Sheets

SLIP, TANGENTIAL SLIP SYSTEM HAVING SLIP, AND METHOD THEREOF

BACKGROUND

In the drilling and completion industry, the formation of boreholes for the purpose of production or injection of fluid is common. The boreholes are used for exploration or extraction of natural resources such as hydrocarbons, oil, gas, water, and alternatively for CO2 sequestration. It is often necessary to anchor equipment within a tubular structure such as a casing or tubing string. A common and long used apparatus for such duty is a set of slips with attendant support structure. In some embodiments, slips are utilized with conical structures that impart radially outwardly directed impetus on each slip as the slip is axially moved along the cone, usually under a compressive load. While such configurations have been extensively used, it is also known that this type of configuration can become stuck in the tubular structure in which it has been set, thereby rendering retrieval thereof difficult.

In another embodiment of a slip configuration, the slips are tangentially loaded to avoid the need for the conical portion. Depending upon the configuration of these tangentially loaded systems, there has been difficulty in retrieval or difficulty in creating acceptable holding strength. U.S. Pat. No. 7,614,449 provides slips that have different lengths to delay a tensile force being applied to the slips when retraction of the slip system is desired, which reduces the force necessary to retract the slip system.

The art would be receptive to alternative devices and methods for improving the retractability of slip systems.

SUMMARY

A slip for a tangentially loaded retrievable slip system, the slip includes a frame including an interior having first and second sides; and, a key having a first portion within the interior of the frame, the first portion having first and second sides, the first portion of the key movable within the interior of the frame; wherein the key is movable from a set condition with at least a contact point of the first and second sides of the first portion of the key pushing against at least a portion of the first and second sides of the interior of the frame in the set condition, respectively, to an unset condition with the first and second sides of the first portion of the key releasing pressure from the first and second sides of the interior of the frame.

A slip system includes a set of drive slips; a set of gripping slips operatively interengagable with the set of drive slips; a drive slip end ring in operable communication with the set of drive slips; and a gripping slip end ring in operable communication with the set of gripping slips, the end rings capable of transmitting a load applied in an axial direction of the system to the set of gripping slips and the set of drive slips to tangentially load the set of drive slips and the set of gripping slips against each other thereby increasing a radial dimension of the system; wherein at least one slip in the set of drive slips and the set of gripping slips is a keyed slip, the keyed slip including: a frame including an interior having first and second sides; and, a key having a first portion within the interior of the frame, the first portion having first and second sides, the first portion of the key movable within the interior of the frame; the key configured for movement from a set condition with at least a contact point of the first and second sides of the first portion of the key pushing against at least a portion of the first and second sides of the interior of the frame in the set condition, respectively, to an unset condition with the first and second sides of the first portion of the key releasing pressure from the first and second sides of the interior of the frame.

A method of managing a tangential load imparted by a tangential slip system, the tangential slip system including a set of drive slips and a set of gripping slips operatively interengagable with the set of drive slips, the method includes providing at least one keyed slip amongst the set of drive slips and the set of gripping slips, the at least one keyed slip having a frame and a first portion of a key movable within the frame; setting the at least one keyed slip by pushing at least one contact point of first and second sides of the first portion of the key against first and second sides of the frame; and, unsetting the at least one keyed slip by moving the key to release pressure from the first and second sides of the frame and at least partially remove a tangential load in the system.

BRIEF DESCRIPTION OF THE DRAWINGS

Referring now to the drawings wherein like elements are numbered alike in the several Figures.

DETAILED DESCRIPTION

Figure 1:
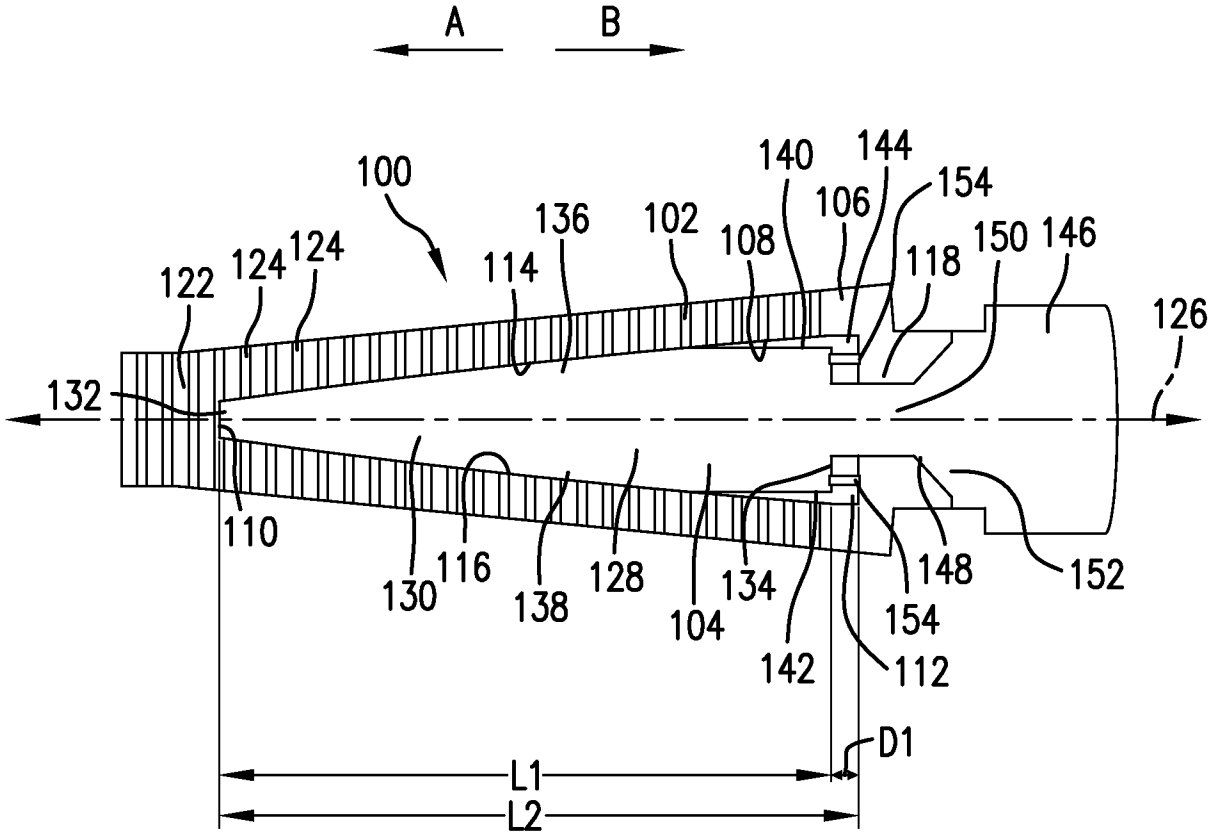
FIG. 1 shows a front plan view of an exemplary embodiment of a slip for a tangentially loaded slip system.
Figure 2:
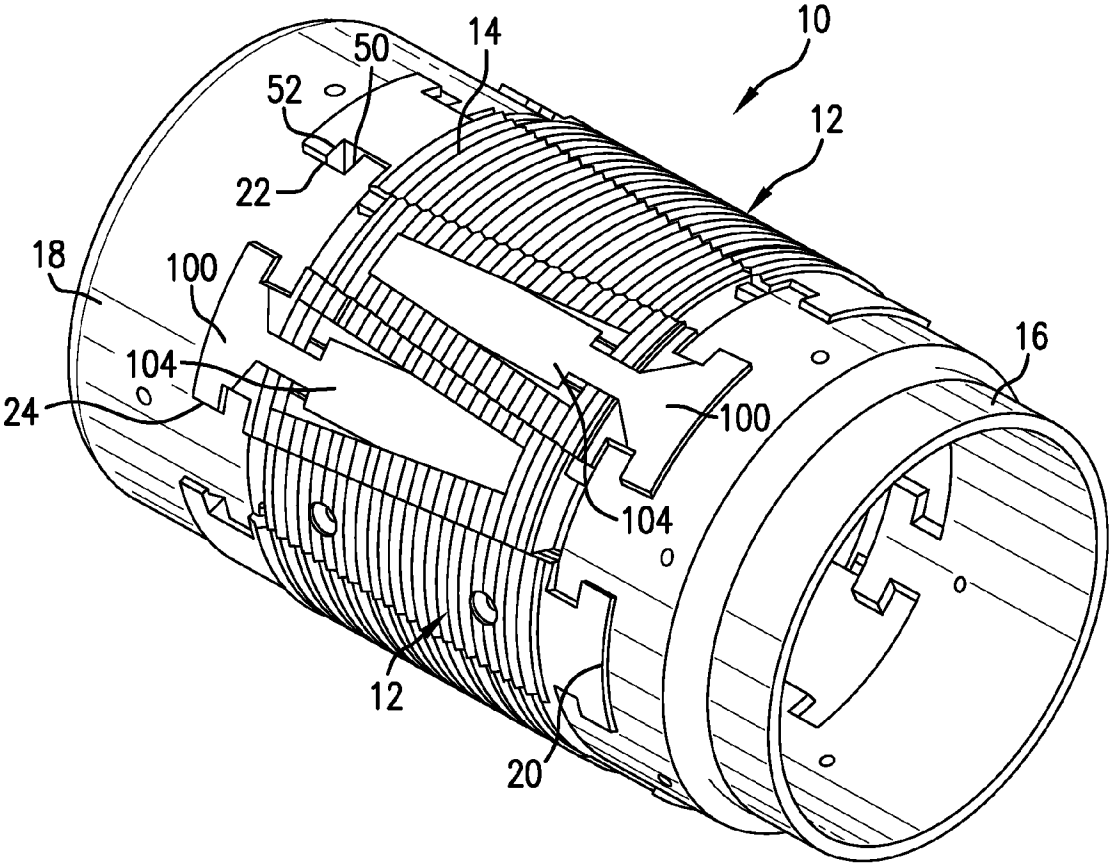
FIG. 2 shows a perspective view of an exemplary embodiment of the slip system disclosed herein in a set position.

FIG. 1 shows an exemplary embodiment of a tangential slip 100 usable in a tangential slip system 10 (see FIG. 2). The slip 100 includes a slip frame 102 and a key 104 movably disposed within the slip frame 102. Due to the key 104 within the frame 102, the slip 100 may also be termed a "keyed slip." The slip frame 102 includes a substantially trapezoid-shaped exterior 106, and a substantially trapezoid-shaped interior 108. The trapezoidal shape, or other tapered profile, of the exterior 106 is important because it facilitates radial expansion of the slip system 10, with reference to FIG. 2, upon axial compression of the system 10 into a shorter axial dimension. Growth in the radial direction is of course important to a slip system because it is such radial growth that allows the system itself to become anchored into the receiving tubular structure. Because of the trapezoidal shape and positioning of that shape, each slip acts as a wedge (perimetrically) against its two neighboring slips. When the axial length of system 10 is increased, the radial dimension of the system 10 will necessarily and naturally decrease.

The interior 108 of the frame 102 has a first end 110 and a second end 112, wider than the first end 110, and first and second sides 114, 116 that connect the second end 112 to the first end 110. The second end 112 serves as a stop shoulder for the key 104. The frame 102 also includes a neck-shaped opening 118 extending from the second end 112 and sized to receive a portion of the key 104, and a tapered receiving portion 120 tapering outwardly from the neck-shaped opening 118. An exterior front surface 122 of the frame 102 is provided with wickers 124 that may extend substantially perpendicular with respect to a longitudinal axis 126 of the slip 100. Unlike the frame 102, an exterior front surface 128 of the key 104 is not provided with wickers, and may be substantially smooth.

Figure 3:
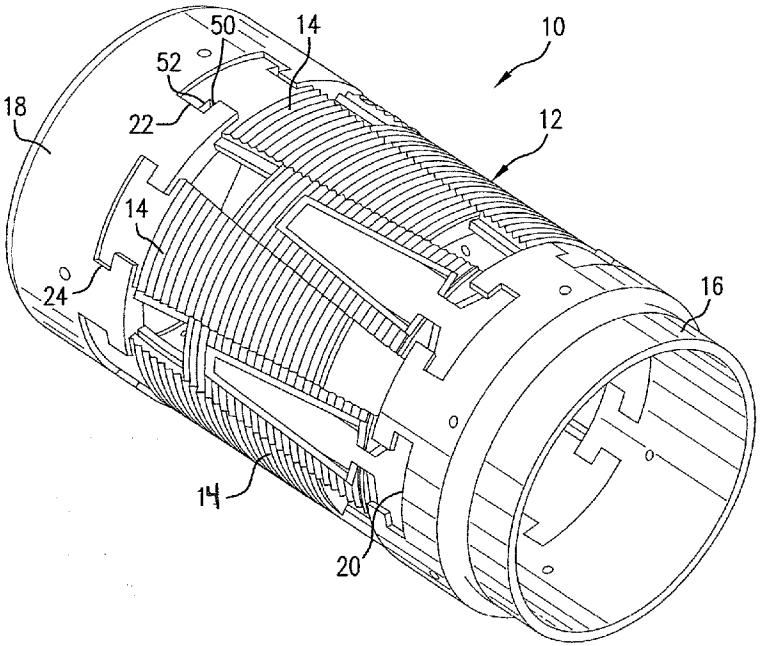
FIG. 3 shows a perspective view of an exemplary embodiment of the slip system disclosed herein in a retracted position.

The key 104 of the slip 100 may include a substantially trapezoidally shaped first portion 130 sized for arrangement within the interior 108 of the frame 102. Alternatively, the key 104 and the interior 108 may include substantially triangular shaped profiles, substantially complementary tapered profiles, profiles having substantially the same or similar angles from the longitudinal axis 126 of the slip 100, or any profile having one or more contact points on either the interior of the frame 102 or first portion 130 of the key 104 that contact each other in a set condition of the slip 100. As illustrated, the first portion 130 includes a first end 132, a second end 134 wider than the first end 132, and first and second sides 136, 138 that connect the first end 132 to the second end 134. Adjacent the second end 134 of the first portion 130 of the key 104, the first and second sides 136, 138 may be truncated, as shown by truncated portions 140, 142. A longitudinal length L1 of the first portion 130 is less than a longitudinal length L2 of the interior 108 of the frame 102 such that the key 104 is slidable within the frame 102 by a distance D1 of the gap 144 from the second end 134 of the first portion 130 to the second end 112 of the interior 108 when the first portion 130 of the key 104 is pushed as far as possible in direction A into the interior 108. When the first end 132 of the first portion 130 of the key 104 abuts with the first end 110 of the interior 108 of the frame 102, a width from the first side 136 to the second side 138 of the first portion 130 of the key 104, at at least one contact point of the first and second sides 136, 138, is greater than a corresponding width from the first side 114 to the second side 116 of the interior 108 of the frame 102. Thus, when the key 104 is moved as far as possible into the frame 102, such as with the first end 132 of the key 104 abutting the first end 110 of the interior 108 of the frame 102, such as in the set position shown in FIG. 1, at least a contact point of the first and second sides 136, 138 of the key 104 push outwardly on the first and second sides 114, 116 of the frame 102, which in turn may push the first and second sides of the exterior 106 of the frame 102 at least slightly outwardly. While the contact point of the first and second sides 136, 138 of the key 104 is illustrated along a substantially linear segment of the sides 136, 138 of the key 104, in alternative embodiments, the first and second sides 136, 138 of the key 104 or the interior 108 of the frame 102 may include one or more protrusions, such as via an undulating or castellated surface, that provide one or more contact points between the key 104 and the interior 108 of the frame 102 in the set condition. Thus, the term "contact point" with respect to the key 104 is meant to encompass any feature of the key 104 that engages with the interior 108 of the frame 102 for the purpose of applying the above-described pressure in the set condition. When the first end 132 of the first portion 130 of the key 104 is pulled away from the first end 132 of the interior 108 of the frame 102, such as shown in FIG. 3, pressure is removed from the first and second sides 114, 116, releasing the outwardly directed pressure experienced by the first and second sides of the frame 102. This action is used advantageously for retrieval purposes as will be described further below.

A second portion 146 of the key 104 includes an outwardly extending shoulder, such as a T-shaped structure, sized for accommodation within and engagement with a slot 20, 22, or 24 in a drive slip ring 16 or gripping slip ring 18, shown in FIG. 2. The first portion 130 is connected to the second portion 146 by a third portion 148. The third portion 148 includes a first section 150 that is narrower than a width of the second end 134 of the first portion 130, and a second section 152 that expands outwardly towards the second portion 146. The first section 150 of the third portion 148 is sized for sliding within the neck-shaped opening 118 of the frame 102, and the second section 152 of the third portion 148 is sized to substantially abut with and nest within the tapered receiving portion 120 of the frame 102 in the set condition of the slip 100. For sliding the key 104 relative to the frame 102, at least one longitudinally extending rod 154, extending substantially parallel to the longitudinal axis 126, is fixedly mounted within the frame 102 and supports the key 104 for slidable movement thereon within the frame 102. Two rods 154 are shown in the illustrated embodiment of the slip 100 in FIG. 1, one on each side of the longitudinal axis 126 of the slip 100 for evenly supporting the key 104 within the frame 102.

The first, second, and third portions 130, 146, 148 of the key 104 may all be integrally connected and uniformly manufactured in a single piece. Likewise, the frame 102 may be an integrally constructed unit. One exemplary method of fabricating the key 104 and the frame 102 includes electrical discharge machining ("EDM"). EDM, otherwise known as spark machining, is a manufacturing process of obtaining a desired shape by using electrical discharges to remove material from a workpiece by a series of rapidly recurring current discharges between two electrodes separated by a dielectric liquid and subject to an electric voltage. EDM is advantageously useful in forming the key 104 and frame 102 of the slip 100 due to the unique shapes and close tolerances that can be obtained with EDM. In other exemplary embodiments, however, the slip 100 may be formed using other machining techniques, so long as the requirements for shape and tolerances are met in the slip system 10.

The slip 100 may be used in place of one or more of a drive slip 12 and a grip slip 14. FIG. 2 shows the slip system 10 including a configuration of a set of drive slips 12 and a set of grip slips 14 that together cooperate in a way that promotes tangential loading of the slips against one another to radially expand. The slip system 10 is similar to the tangentially-loaded high-load retrievable slip system disclosed in U.S. Pat. No. 7,614,449, herein incorporated by reference in its entirety, however the slip system 10 includes at least one tangential slip 100 having key 104. For exemplary purposes only, the slip 100 is shown in place of one of the drive slips 12 and one of the grip slips 14, however the slip 100 may also replace more than one of the drive slips 12, and/or one or more of the grip slips 14, or may only replace only one or all of the drive slips 12 or only one or all of the grip slips 14. Radial expansion of the slip system 10 is necessary to set the system 10 by driving certain portions of the wicker threads (numerically introduced and discussed hereunder) into a receiving tubular structure (not shown). System 10 further includes a drive slip ring 16 and a grip slip ring 18. Ring 16 is endowed with interengagement (for example, T-shaped) slots 20 about a perimeter thereof, each of the slots 20 being substantially the same shape and set of dimensions as each other. Ring 18 on the other hand, in one embodiment, may include a plurality of interengagement (for example, T-shaped) slots 22 disposed about a periphery thereof having a first set of dimensions and a plurality of interengagement (for example, T-shaped) slots 24 having another set of dimensions. In the illustrated embodiment of FIG. 1, slots 22 and 24 alternate (single alternating) around the perimeter of ring 18. It is to be understood, however, that more of slot 22 or slot 24 could be grouped together in alternate embodiments such as, for example, two slot 22's next to one another and two slot 24's next to one another alternating with the 22's (double alternating). Further, there is no requirement that there be any particular number of a certain type of slot 22 or 24, for example, there may only be one slot 24 or two slots 24, etc. or each slot could be unique as desired (random alternating). While an embodiment of ring 18 will be described having slots 22, 24 with different dimensions, for the reasons described below, due to the key 104 of the slip 100 as described herein, another exemplary embodiment of the ring 18 may also include slots having the same dimensions, e.g. slots 24, for all of the grip slips 14 and or keyed slips 100 disposed therein.

In each of the rings 16 and 18, the position of slots 20, 22 or 24 are such, relative to each other, that slips 12 and 14, and slip 100 where utilized, are alternately positioned when engaged with adjacent T-shaped slots in each ring. The alternate positioning of slips 12 and 14 is easily seen in FIGS. 1 and 2.

It is to be noted that the radial expansion of system 10 is affected entirely by tangential application of force through the slips 12, 14, 100; this means that the ID of the slip system 10 can remain completely open and that conical structures previously used to radially displace slips are not necessary.

Figure 4:
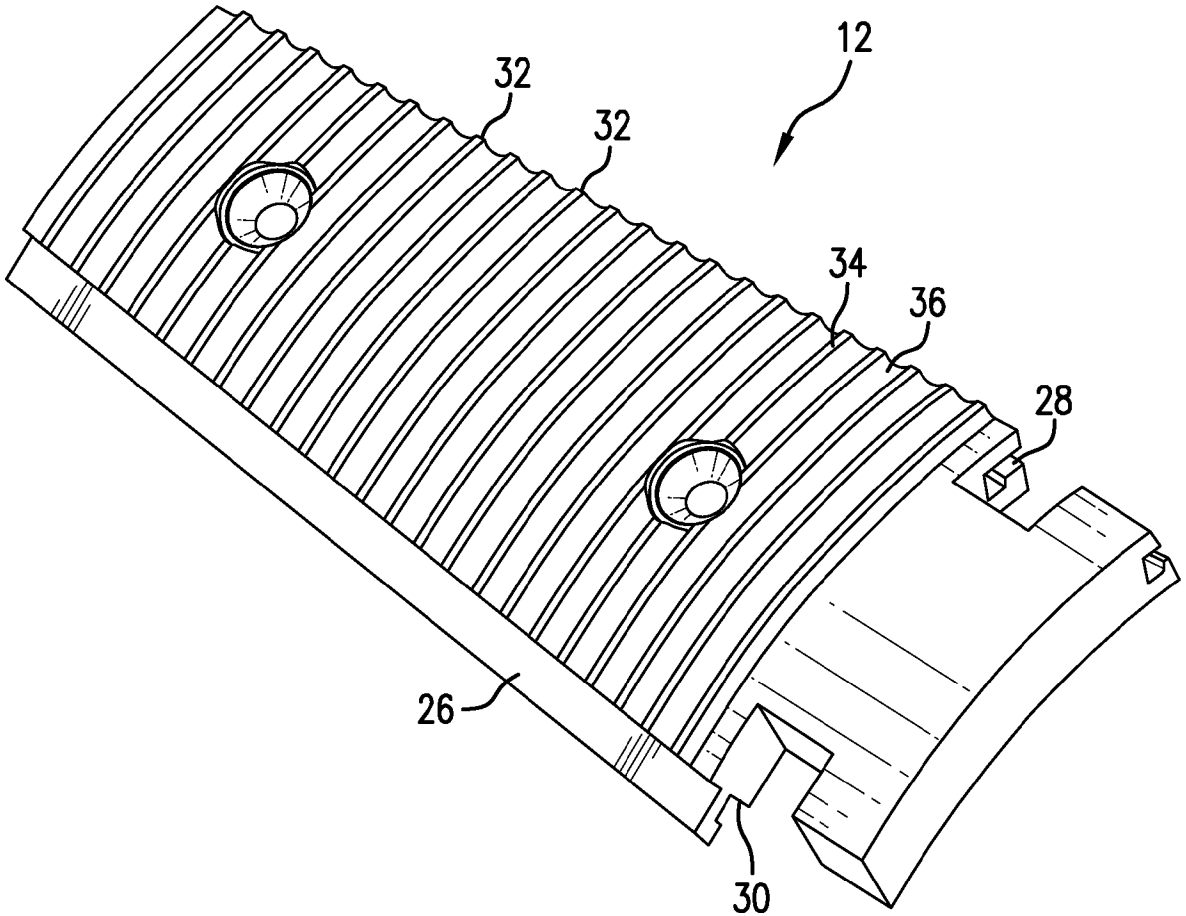
FIG. 4 shows a perspective view of one of the slips from the illustration of FIG. 2.
Figure 5:
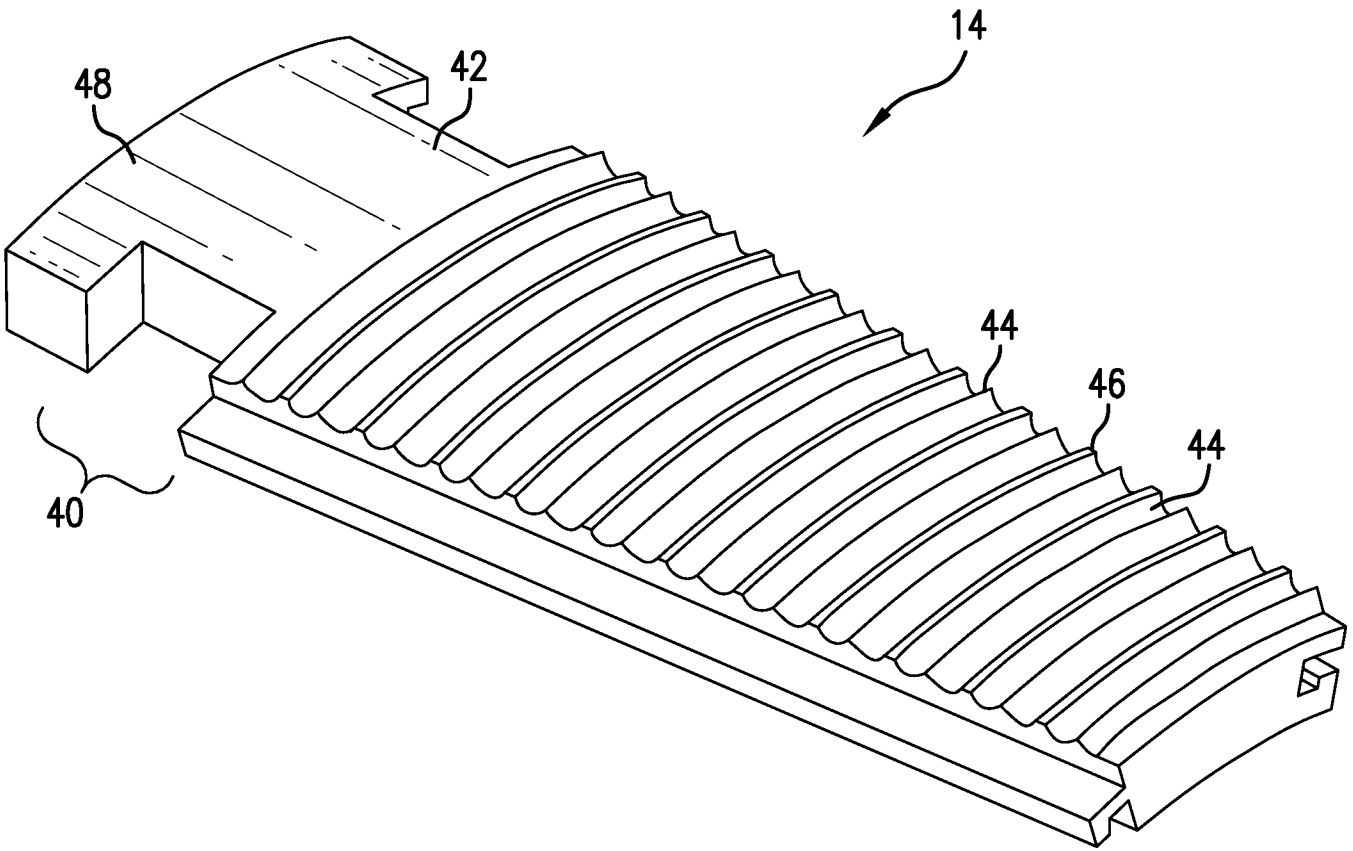
FIG. 5 shows a perspective view of another of the slips illustrated in FIG. 1.

FIGS. 4-5 show an exemplary drive slip 12 and grip slip 14, respectively, for use in the slip system 10. If not all of the slips 12, 14 are replaced with the slips 100, then these exemplary slips 12, 14 can be used in the slip system 10. Also, features of the slips 12, 14 that are described in detail below can also be incorporated into the slip. Referring now to FIG. 4, one of the drive slips 12 is illustrated in perspective view and enlarged from the FIGS. 2 and 3 views. In the FIG. 4 view there is visible interlocking members provided in each of the slips in order to keep them engaged as a single unit while simultaneously allowing them to slide relative to each other. Each one of the slips includes a keyed flange 26, which in the embodiment illustrated, is of L-shape but may be of any shape that allows sliding motion while inhibiting disassociation of each slip from its neighboring slip. On an opposite side of slip 12 is a complementary flange keyhole 28, one end of which is visible. It will be understood that the flange keyhole 28 extends the length of slip 12 as does keyed flange 26. If one were to obtain an opposing slip (i.e. slip 14) one would notice that the keyed flange 26 and the flange keyhole 28 can be engaged as the slips 12 and 14 slid axially relative to one another. Sliding movement is thus enabled while lateral disassociation is prevented or at least inhibited. It should be further noted that the frame 102 of slip 100 is also provided with keyed flange 26 and flange keyhole 28 for complementarily fitting with interengaged slips 12 and 14.

It should also be noted in passing that an angle of the mating surfaces 30, on each slip 12 and 14, is dictated by a radius extending from the axis of system 10. This angle ensures smooth and distributed contact along each face 30 to improve overall efficiency and strength of system 10.

Still referring to FIG. 4, an exemplary embodiment of drive slips 12 may possess a number of wickers 32, a substantial number of which are truncated. In the illustrated embodiment, all of the wickers 32 are truncated, but it is to be appreciated that merely a substantial number of the wickers can be truncated to achieve the benefit of distribution of stresses in the receiving tubular structure. It is possible to add pointed wickers without departing from the scope of the invention. Truncation 34 removes what would otherwise be a sharper point of a slip gripping wicker. In one embodiment the truncation amount is of a dimension that is about the same as the amount of a sharp wicker that would be embedded in the material of the receiving tubular structure. Slips 12 are so configured to enhance retrievability of the slip system 10 as well as assist in the distribution of stresses in the receiving tubular structure. Due to the key 104 of the slip 100, the slips 12 need not necessarily include all truncated wickers 32, however exemplary embodiments may include any number of truncated wickers 32. Also, the wickers 32 are also employable on the frame 102 of the slip 100, in place of wickers 124.

Each one of the wickers 32 that is truncated, is so truncated to an extent about equal to the amount of penetration into the receiving tubular structure that is anticipated for pointed wickers on the gripping slips 14. The reason for this is so that when the pointed wickers are maximally embedded in the receiving tubular structure, the wickers 32 will be radially loaded against the receiving tubular structure without penetrating it into. This distributes the stresses of the receiving tubular structure more evenly about the tubular structure consistent with contact around the entirety of the slip system 10. One further benefit of the configuration of slips 12 is realized in the case of paraffin or other debris lining the inside dimension of the receiving tubular structure. Because wickers 32 are still above the surface of slips 12, those wickers are able to penetrate debris at the inside dimension of the receiving tubular structure and still ensure contact of truncation 34 with the inside dimension surface of the receiving tubular structure forming a frictional engagement therewith.

Each wicker 32, of course, possesses a pair of flanks 36, which in one embodiment, are positioned at 45°. It is to be understood that other angles are possible. It is also noted that in the system 10, it is not necessary to harden wickers 32, as they are not intended to bite into the receiving tubular structure. This is not to say that it is undesirable to harden wickers 32 but merely that it is not necessary to do so.

Referring to FIG. 5, an exemplary embodiment of the gripping slips 14 is illustrated. It will be noted that there are two distinguishing features of gripping slip 14 over driving slip 12 as illustrated in FIG. 4. These are a length 40 of a T-upright 42, and a configuration of wickers 44 and 46. Addressing the wickers first, it will be apparent that in the illustrated embodiment, every other wicker is sharp pointed (wicker 44) while the intervening wickers 46 are truncated (single alternating). In this embodiment, the degree of truncation of wickers 46 is roughly equal to the expected penetration of wickers 44 into the receiving tubular structure (not shown). Again the purpose for this construction, like that of the drive slip illustrated in FIG. 4, is to distribute the load on the receiving tubular structure imparted by radial motion of slip system 10. More specifically, upon full penetration of wickers 44 into the receiving tubular structure, wickers 46 come into contact with the inside diameter of the receiving tubular structure thereby distributing stress in that structure. It is to be appreciated that only one embodiment of the slip system contemplated is shown in FIG. 5. It is also possible for numbers of wickers 44 and 46 to be grouped such as two wickers 44 alternating with two wickers 46 (double alternating) or three wickers 44 alternating with three wickers 46 (triple alternating) or even a number of sharp wickers 44 alternating with a different number of truncated wickers 46 (random alternating). The overall point of alternating sharp and truncated wickers is to distribute stress otherwise imparted in an undistributed way to the receiving tubular structure. It is further possible to retain all of the wickers on slips 14 in the 44 configuration in some embodiments of the invention, since the truncated wickers 32 on the drive slips 12 will still substantially balance stresses in the receiving tubular structure. It will also be noted that pointed wickers 44 should be hardened such that they are sufficiently durable to penetrate the inside diameter of the receiving tubular structure. It is further noted that the wickers 44, 46 may be employed on the frame 102 of the slip 100 in lieu of wickers 124.

Addressing now the upright 42 of the key structure 48, and referring to both FIGS. 4 and 5, it is apparent that the length 40 of the upright section 42 is longer than that of the comparable portion of slip 12. The reason for the length of this portion of slip 14 is to delay a tensile force being applied to this slip 14 when retraction of the slip system 10 is desired. Referring back to FIGS. 2 and 3 and reiterating that the T-shaped slots 22 and 24 are distinct, a review of the drawing will make clear that T-shaped slots 24, upon an axial tensile load on ring 18, will cause an immediate transfer of the tensile load to the associated slip 14. This is distinct from the T-shaped slots 22 wherein the same tensile load applied to ring 18, is not immediately transferred to the associated slip 14 but rather the ring 18 must axially move relative to the associated slip 14 until surface 50 contacts surface 52. Upon this contact, the tensile load will be transmitted to the associated slip 14. In such configuration it will be appreciated that every other slip 14, in the illustrated embodiment, will be pulled in a direct commensurate with retracting the slip system 10 prior to the other slips 14 being so pulled. This reduces the force necessary to retract the slip system 10. In the illustrated embodiment, the force is roughly halved while in other embodiments with differing numbers of alternating T-shaped slots 22 and 24, the reduction in tensile force required will be describable as a percentage of the whole proportional to the number of earlier pulled slips relative to the total number of slips associated with the subject ring. In view of the keyed slip 100, the length 40 of the upright section 42 may alternatively be consistent with that of the drive slip 12.

As noted above, ring 16 is illustrated to contain only T-shaped slot 20. The reason that the staggered T-shaped slots are not employed on ring 16 is that all of the associated slips 12 substantially lack gripping wickers and therefore, the tensile force required to unseat them is substantially less than that of the slips 14. Therefore, there is no need to stagger the T-shaped slots in ring 16. This is by no means to say that it is inappropriate to stagger T-shaped slots 20, as it certainly is not only possible and functional, but rather merely to state that it is unnecessary.

Figure 6:
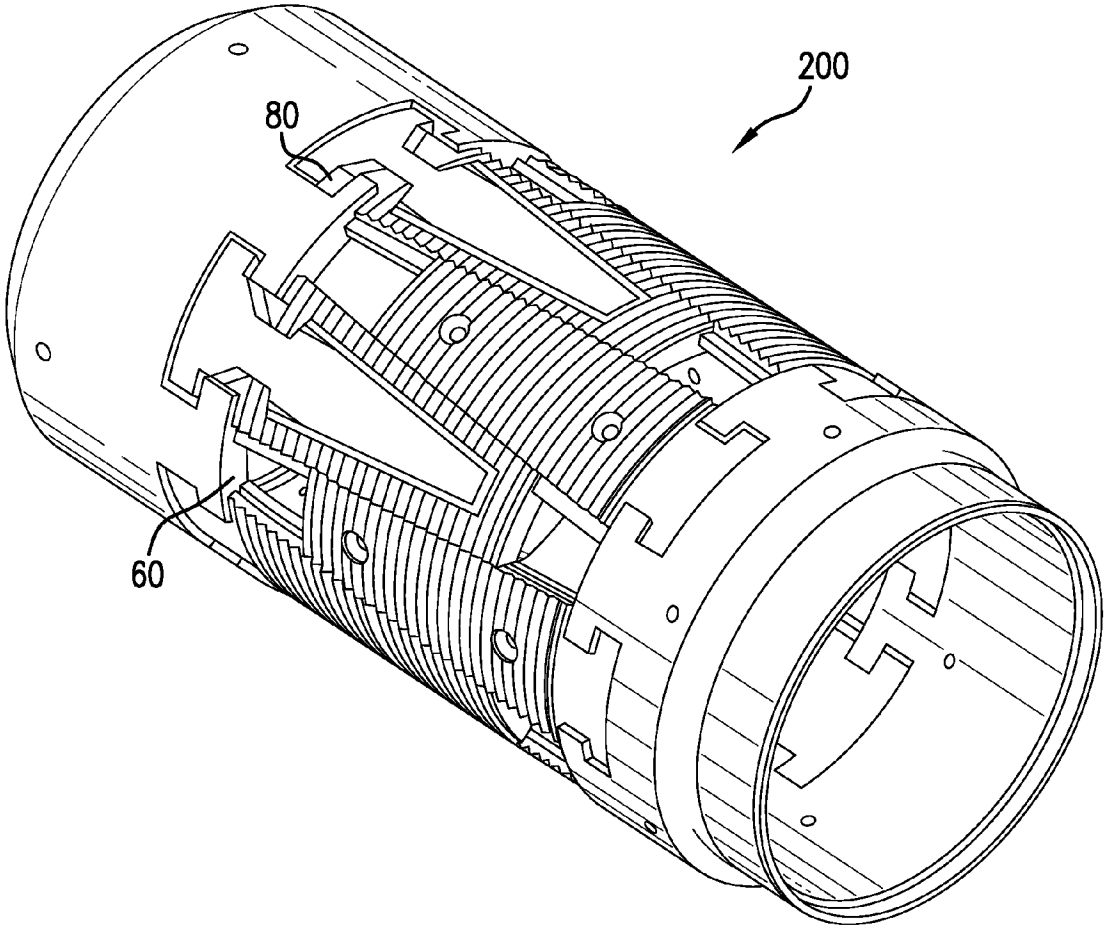
FIG. 6 shows a perspective view of an alternate exemplary embodiment of a slip ring configured to unset the slip system.

When the slip 100 is employed, as exemplarily demonstrated in FIGS. 2, 3, and 6, the necessity of having slips 14 positioned within varying slots 22, 24 is reduced as the slip 100 is designed to allow the slip system 10 to relax, thus easing retrieval of a packer or bridge plug. Thus, while the system 10 is illustrated as including slots 22, 24, because the slips 100 reduce the force necessary to retract the slip system 10, the system 10 may alternatively include slots of equal size for the slips 14 since the slips 100 can effectively be employed to remove the built in tangential load from the slip system 10.

FIG. 2 shows the slips 100, 12, 14 in a set condition of the slip system 10. With additional reference to FIG. 1, the first end 132 of the key 104 of the slip 100 is pushed towards the first end 110 of the interior 108 of the frame 102, by a respective one of the rings 16, 18, and the first and second sides 136, 138 of the key 104 push radially outwardly towards the first and second sides 114, 116 of the frame 102 to assist in the tangential loading of the system 10. When retrieval of the packer or bridge plug is necessary, unsetting of the slip system 10 will involve applying a tensile load on at least one of the rings 16, 18 to pull on the second portion 146 of the key 104 in direction B. Because the key 104 is movable within the frame 102, the frame 102 does not immediately move in the longitudinal direction with the key 104. Also, because the key 104 does not include wickers and is therefore not embedded in a receiving tubular structure, it is readily pulled in the axial direction without the frame 102. As soon as the key 104 is longitudinally moved within the frame 102 from a set condition to an unset condition, the tangential load that exists between the slips 100, 12, 14 in the system 10 is relieved, significantly improving retrievability of both the system 10 and any associated tool structure. The second end 134 of the first portion 130 of the key 104 then abuts with the second end 112 of the interior 108 of the frame 102 such that continued tensile load on the ring 16 or 18 will move the slip 100, including the frame 102, to the unset condition as shown in FIG. 3.

Referring to FIG. 6, an alternate embodiment of slip system 200 is substantially the same as the slip system 10 except that the slip system 200 includes a ring 18 which allows for the T-shaped structures on each of the slips 14 to be identical. In this embodiment, the T-shaped structure 48 is not required to be long, as it is illustrated in the FIG. 2 and FIG. 3 embodiments. It will be appreciated that the reason that the elongated section 42 is not needed, is that surface 50 of slots 22 is positioned closer to an end 60 of ring 18 than it is in the FIG. 2 embodiment. One will also note that the clearances between the T-shaped structure 48 and the slots 22 has also been increased to account for potential axial movement of the system 200. This additional clearance alleviates unnecessary load on the structure 48 when the system is set. In this embodiment, two slips 100 are shown replacing slips 14 for exemplary purposes only. As noted above, any number of slips 100 could be employed in the system 10, 200 to replace either or both of slips 12, 14, and therefore the particular arrangements of slips 100, 12, 14 shown in the figures is meant to be illustrative of exemplary applications rather than limiting embodiments.

While the figures in this application may suggest to one of ordinary skill in the art the existence of a clear uphole end and downhole end of slip system 10, based upon conventional illustration methods, it is to be understood that slip system 10 is usable with either end uphole. Generally, it will be desirable to impart a compressive setting force against ring 16 and the drive slips 12 while maintaining ring 18 and gripping slips 14 stationary. This is, however, not a requirement and the slip system 10 is to be understood to be actuable and retractable from either end. It is also to be understood that the system is actuable and retractable from a position downhole of the system of a position uphole of the system.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

The invention claimed is:

1. A slip for a tangentially loaded retrievable slip system, the slip comprising:

a frame including an interior having first and second sides, the frame having a substantially tapered exterior periphery, the frame including a plurality of wickers; and, a key having a first portion within the interior of the frame, the first portion having first and second sides, the first portion of the key movable within the interior of the frame, the key being free of wickers;

wherein the key is movable from a set condition with at least a contact point of the first and second sides of the first portion of the key pushing against at least a portion of the first and second sides of the interior of the frame in the set condition, respectively, to an unset condition with the first and second sides of the first portion of the key releasing pressure from the first and second sides of the interior of the frame, and, in the unset condition, continued longitudinal movement of the key moves the frame longitudinally within the slip system.

2. The slip of claim 1 wherein the substantially tapered exterior periphery is engageable with at least one of a drive slip, a gripping slip, and another keyed slip.

3. The slip of claim 1 further comprising at least one sliding rod supporting slidable movement of the key within the frame.

4. The slip of claim 1 wherein the key further includes a second portion extending outside of the interior of the frame in both the set and unset conditions.

5. The slip of claim 4 wherein the second portion of the key includes an outwardly extending shoulder.

6. The slip of claim 4 wherein the frame includes a neck shaped opening, an end of the first portion of the key and the second portion of the key having larger widths than a width of the neck shaped opening in the frame.

7. The slip of claim 6 wherein the key further includes a third portion connecting the first portion to the second portion, the third portion extending through the neck shaped opening in the frame.

8. The slip of claim 1 wherein the first portion of the key and the interior of the frame each have substantially tapered profiles, and a length of the first portion of the key is less than a length of the interior of the frame.

9. A slip for a tangentially loaded retrievable slip system, the slip comprising:

a frame including an interior having first and second sides, the interior of the frame includes a first end and a second end connecting the first side of the interior to the second side of the interior; and, a key having a first portion within the interior of the frame, the first portion having first and second sides, the first portion of the key movable within the interior of the frame, the first portion of the key includes a first end and a second end connecting the first side of the first portion of the key to the second side of the first portion of the key;

wherein the key is movable from a set condition with at least a contact point of the first and second sides of the first portion of the key pushing against at least a portion of the first and second sides of the interior of the frame in the set condition, respectively, to an unset condition with the first and second sides of the first portion of the key releasing pressure from the first and second sides of the interior of the frame, and the second end of the first portion of the key positioned further from the second end of the interior of the frame in the set condition than in the unset condition.

10. The slip of claim 9 wherein the second end of the first portion of the key abuts with the second end of the interior of the frame in the unset condition.

11. A slip system comprising:

a set of drive slips;

a set of gripping slips operatively interengagable with the set of drive slips;

a drive slip end ring in operable communication with the set of drive slips; and a gripping slip end ring in operable communication with the set of gripping slips, the end rings capable of transmitting a load applied in an axial direction of the system to the set of gripping slips and the set of drive slips to tangentially load the set of drive slips and the set of gripping slips against each other thereby increasing a radial dimension of the system;

wherein at least one slip in the set of drive slips and the set of gripping slips is a keyed slip, the keyed slip including:

a frame including an interior having first and second sides, the frame including a plurality of wickers; and, a key having a first portion within the interior of the frame, the first portion having first and second sides, the first portion of the key movable within the interior of the frame, the key being free of wickers;

the key configured for movement from a set condition with at least a contact point of the first and second sides of the first portion of the key pushing against at least a portion of the first and second sides of the interior of the frame in the set condition, respectively, to an unset condition with the first and second sides of the first portion of the key releasing pressure from the first and second sides of the interior of the frame.

12. The slip system as claimed in claim 11 wherein the drive slip end ring and the gripping slip end ring each include a plurality of interengagement slots, the key further including a second portion positioned exteriorly of the interior of the frame, the second portion of the key received within a respective interengagement slot.

13. The slip system as claimed in claim 12 wherein the keyed slip is configured such that, during an unsetting operation, axial movement of the end ring having the respective interengagement slot longitudinally moves the key relative to the frame prior to moving the key and frame together.

14. A slip system comprising:

a set of drive slips;

a set of gripping slips operatively interengagable with the set of drive slips;

a drive slip end ring in operable communication with the set of drive slips; and a gripping slip end ring in operable communication with the set of gripping slips, the end rings capable of transmitting a load applied in an axial direction of the system to the set of gripping slips and the set of drive slips to tangentially load the set of drive slips and the set of gripping slips against each other thereby increasing a radial dimension of the system;

wherein at least one slip in the set of drive slips and the set of gripping slips is a keyed slip, the keyed slip including:

a frame including an interior having first and second sides, and the interior of the frame includes a first end and a second end connecting the first side of the interior to the second side of the interior; and, a key having a first portion within the interior of the frame, the first portion having first and second sides, the first portion of the key movable within the interior of the frame, and the first portion of the key includes a first end and a second end connecting the first side of the first portion of the key to the second side of the first portion of the key;

the key configured for movement from a set condition with at least a contact point of the first and second sides of the first portion of the key pushing against at least a portion of the first and second sides of the interior of the frame in the set condition, respectively, to an unset condition with the first and second sides of the first portion of the key releasing pressure from the first and second sides of the interior of the frame, and the second end of the first portion of the key positioned further from the second end of the interior of the frame in the set condition than in the unset condition.

15. A method of managing a tangential load imparted by a tangential slip system, the tangential slip system including a set of drive slips and a set of gripping slips operatively interengagable with the set of drive slips, the method comprising:

providing at least one keyed slip amongst the set of drive slips and the set of gripping slips, the at least one keyed slip having a frame including wickers and a first portion of a key free of wickers movable within the frame;

setting the at least one keyed slip by pushing at least one contact point of first and second sides of the first portion of the key against first and second sides of the frame; and, unsetting the at least one keyed slip by moving the key to release pressure from the first and second sides of the frame and at least partially remove a tangential load in the system, wherein unsetting the at least one keyed slip includes moving the key prior to moving the frame, and subsequently moving the frame with the key.

16. The method of claim 15 wherein unsetting the at least one keyed slip includes axially moving an end ring connected to the set of drive slips or the set of gripping slips.

* * * * *